US008317045B2

(12) United States Patent
Cavalcante

(10) Patent No.: US 8,317,045 B2
(45) Date of Patent: Nov. 27, 2012

(54) COLLAPSIBLE CONTAINER

(75) Inventor: Mauricio D. Cavalcante, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 414 days.

(21) Appl. No.: 12/629,344

(22) Filed: Dec. 2, 2009

(65) Prior Publication Data

US 2010/0133267 A1 Jun. 3, 2010

Related U.S. Application Data

(60) Provisional application No. 61/119,173, filed on Dec. 2, 2008.

(51) Int. Cl.
*B65D 6/16* (2006.01)

(52) U.S. Cl. ..... 220/6; 220/7; 220/4.28

(58) Field of Classification Search ..... 206/506, 206/507, 510, 821, 386; 220/4.01, 4.28, 220/6, 600, 647, 7, 9.1, 9.2
See application file for complete search history.

(56) References Cited

U.S. PATENT DOCUMENTS

| | | | | |
|---|---|---|---|---|
| 4,081,099 | A | 3/1978 | Shead | |
| 4,362,244 | A * | 12/1982 | Cornou | 206/507 |
| 4,423,813 | A | 1/1984 | Kreeger et al. | |
| 4,573,577 | A | 3/1986 | Miller | |
| 5,772,033 | A | 6/1998 | Loftus et al. | |
| 5,924,572 | A * | 7/1999 | Cope | 206/518 |
| 7,357,269 | B2 | 4/2008 | Apps | |
| D600,018 | S | 9/2009 | Cope | |
| 2005/0205454 | A1 * | 9/2005 | McDade | 206/505 |
| 2007/0095842 | A1 | 5/2007 | Apps | |
| 2007/0125779 | A1 | 6/2007 | Cope | |
| 2008/0116201 | A1 | 5/2008 | Baltz | |
| 2009/0289059 | A1 * | 11/2009 | Tontarelli | 220/7 |
| 2010/0044371 | A1 * | 2/2010 | Koefelda | 220/7 |

FOREIGN PATENT DOCUMENTS

| | | |
|---|---|---|
| DE | 1 536 040 | 12/1969 |
| DE | 35 11 321 | 10/1986 |
| DE | 35 21 894 | 1/1987 |
| DE | 199 39 019 | 2/2001 |
| DE | 200 02 537 | 7/2001 |
| EP | 0 073 357 | 3/1983 |

(Continued)

OTHER PUBLICATIONS

Decision on Appeal for U.S. Appl. No. 11/264,371 mailed on May 11, 2009.

(Continued)

*Primary Examiner* — Luan K Bui
*Assistant Examiner* — Brijesh Patel
(74) *Attorney, Agent, or Firm* — Carlson, Gaskey & Olds, P.C.

(57) ABSTRACT

A collapsible container is provided which includes a base, a pair of opposed side walls, and a pair of opposed end walls which are transverse to the side walls. The side and end walls are pivotably connected to the base between an upright position generally perpendicular to the base and a collapsed position on the base. A support is pivotably and slidably mounted to each of the end walls. The support is configured to extend into the container and to fully retract within the end wall. The support extends far enough into the container to reliably support another container thereon.

18 Claims, 14 Drawing Sheets

FOREIGN PATENT DOCUMENTS

| | | |
|---|---|---|
| EP | 0 299 657 | 1/1989 |
| EP | 0 341 074 | 11/1989 |
| EP | 0 385 914 | 9/1990 |
| EP | 0 404 041 | 12/1990 |
| EP | 0 785 142 | 7/1997 |
| EP | 0 962 396 | 12/1999 |
| EP | 1 114 779 | 7/2001 |
| EP | 1 241 105 | 9/2002 |
| EP | 1 785 360 | 5/2007 |
| EP | 2 090 518 | 8/2009 |
| FR | 2 702 198 | 3/1993 |
| GB | 2 124 588 | 2/1984 |
| GB | 2 129 401 | 5/1984 |
| GB | 2 141 778 | 1/1985 |
| GB | 2 171 980 | 9/1986 |
| GB | 2 340 482 | 2/2000 |
| GB | 2 431 921 | 5/2007 |
| GB | 2 431 922 | 5/2007 |
| GB | 2 438 506 | 11/2007 |
| GB | 2 443 949 | 5/2008 |
| GB | 2 452 647 | 7/2009 |
| NL | 7905105 | 12/1980 |
| WO | 97/49613 | 12/1997 |
| WO | 98/56668 | 12/1998 |
| WO | 00/27716 | 5/2000 |
| WO | 00/66440 | 11/2000 |
| WO | 01/44060 | 6/2001 |
| WO | 03/104094 | 12/2003 |
| WO | 2008/062494 | 5/2008 |

OTHER PUBLICATIONS

European Search Report for EP Application No. 09177790.4, Feb. 16, 2010.

* cited by examiner

COLLAPSIBLE CONTAINER

This application claims priority to U.S. Provisional Application No. 61/119,173 which was filed on 2 Dec. 2008.

BACKGROUND OF THE INVENTION

The present invention relates generally to collapsible crates and more particularly to a collapsible crate with retractable support members for supporting another container thereon.

Collapsible crates are well known. Four walls are each connected via a hinge to a base and are selectively movable about the hinge between an upright (or use) position, in which the wall is generally perpendicular to the base, and a collapsed position onto the base. Various latch mechanisms have been provided to connect adjacent walls at the corner to selectively lock the crate in the use position.

Some collapsible crates also include retractable supports so that another container can be supported thereon. One such crate includes end walls, each of which have a support that is partially supported on the adjacent walls when in the support position. However, in some of the designs, the support does not extend far enough into the mouth of the container, away from the end wall. As a result, it is difficult to reliably stack the other container onto the supports without the other container slipping down between the supports. It would be desirable for the supports to extend further into the container, without interfering with the goods in the container below the supports, and such that the supports are still able to be fully retracted out of the interior of the container.

SUMMARY OF THE INVENTION

The present application provides a collapsible container including a base, a pair of opposed side walls, and a pair of opposed end walls which are transverse to the side walls. The side and end walls are pivotably connected to the base between an upright position, generally perpendicular to the base, and a collapsed position on the base. The end wall includes a support which is pivotably and slidably mounted thereto. The support is movable between a retracted position, received substantially within the end wall, and a support position extending into the container. When the side wall and the end wall are in the upright position, the support may be urged toward the support position by an optional arm extending from the side wall. Further, the support is pivotably mounted to the end wall about a movable pivot axis. Particularly, the pivot axis slides closer to the upper edge of the end wall when the support is in the support position than when the support is in the retracted position. Thus, the support can be fully retracted within the end wall and allow the support to extend far enough into the container so that it can be used to reliably support another container.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
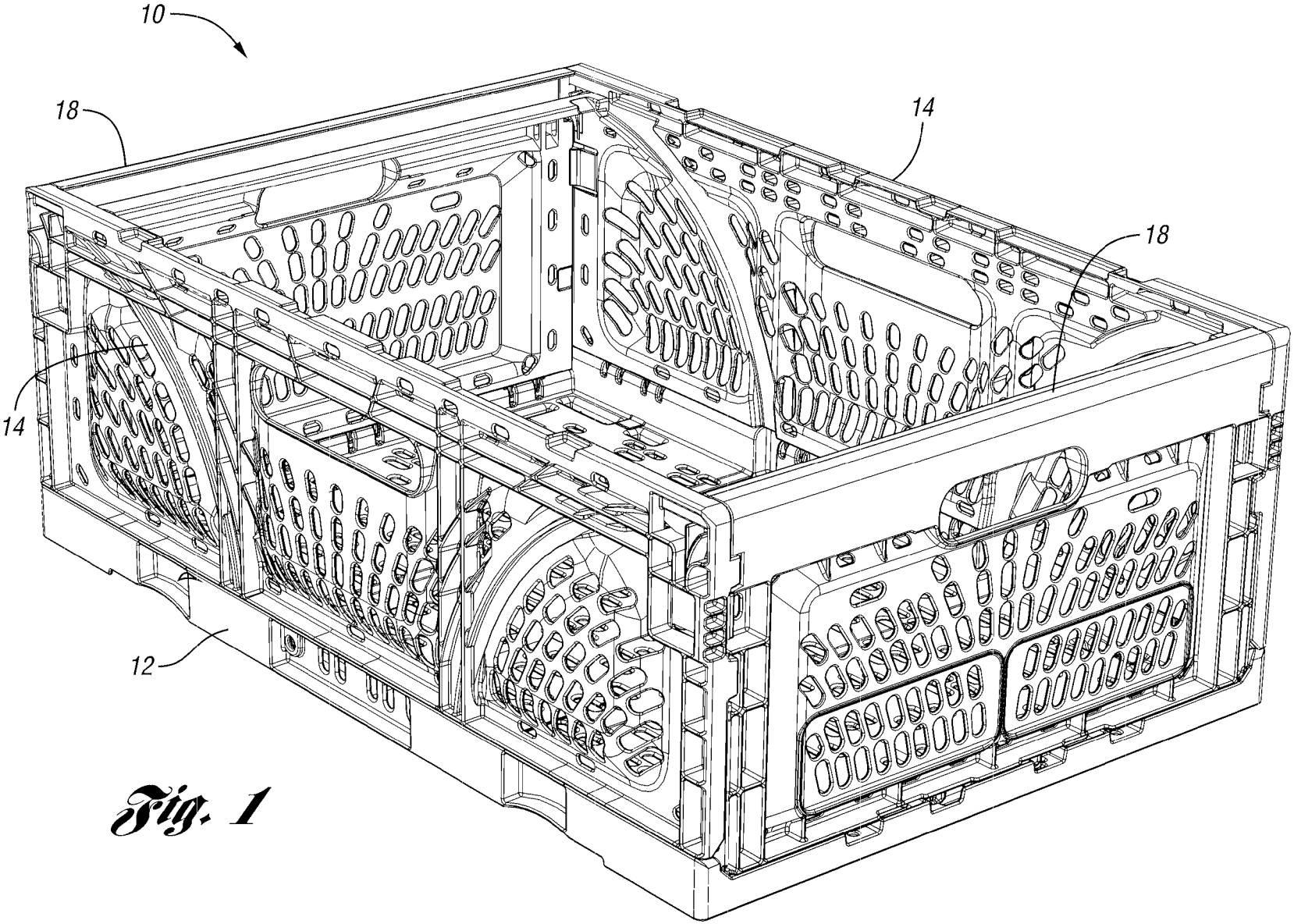
FIG. 1 is a perspective view of the container of the present application in an upright, assembled position.

FIG. 1 is a perspective view of the collapsible container 10 in an upright position. The container 10 includes a base 12, upstanding side walls 14 (or long walls) and upstanding end walls 18 (or short walls). The side walls 14 and end walls 18 are pivotably connected along long and short edges of the base 12, respectively.

Figure 2:
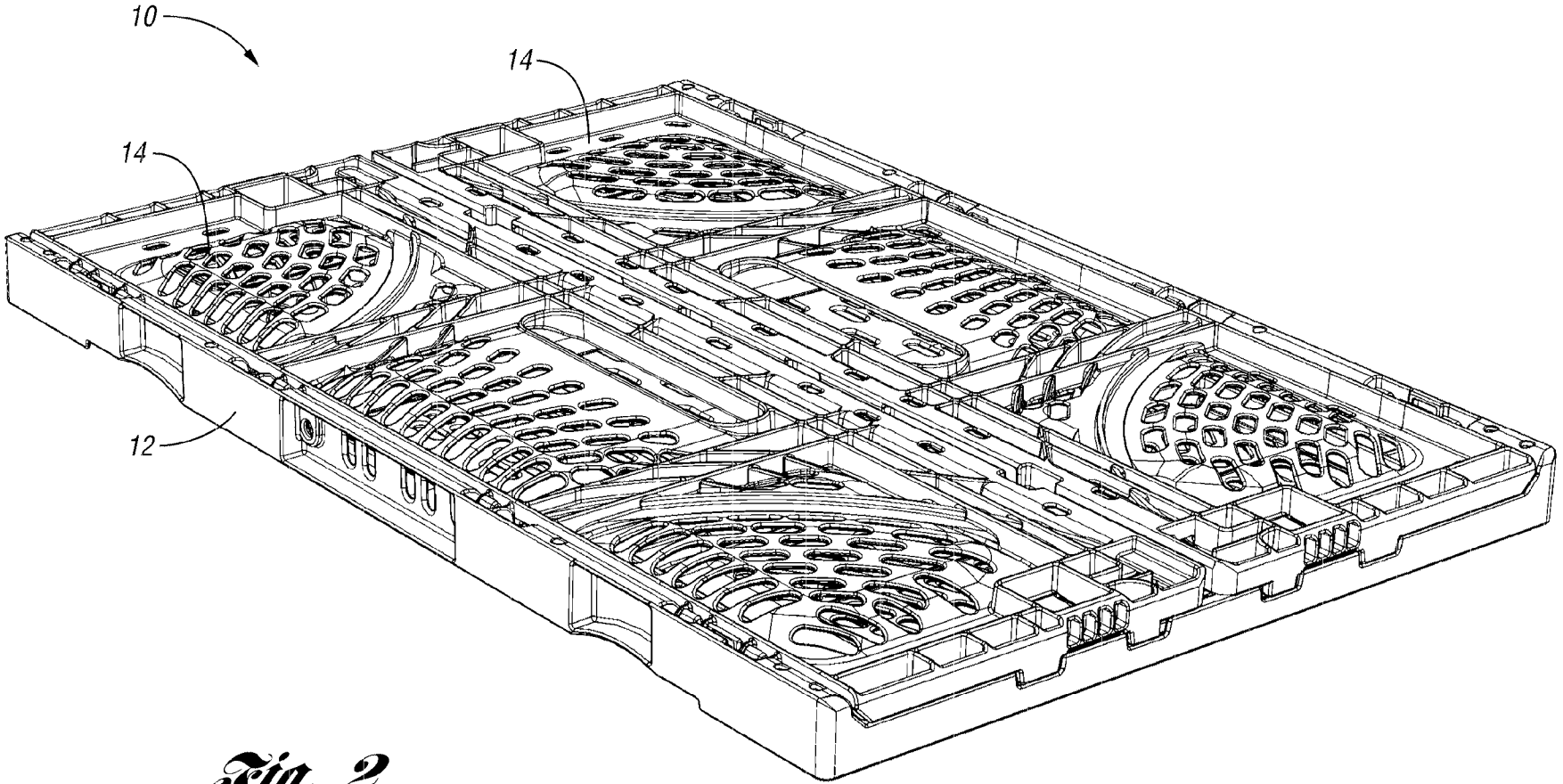
FIG. 2 is a perspective view of the container of the present application in a collapsed position.

FIG. 2 portrays the collapsible container 10 in the collapsed position. The end walls 18 are collapsed onto the base 12, and the side walls 14 are collapsed onto the end walls 18. By collapsing the container 10 in this manner, the volume of the container 10 is reduced and the container 10 can be easily stored.

Figure 3:
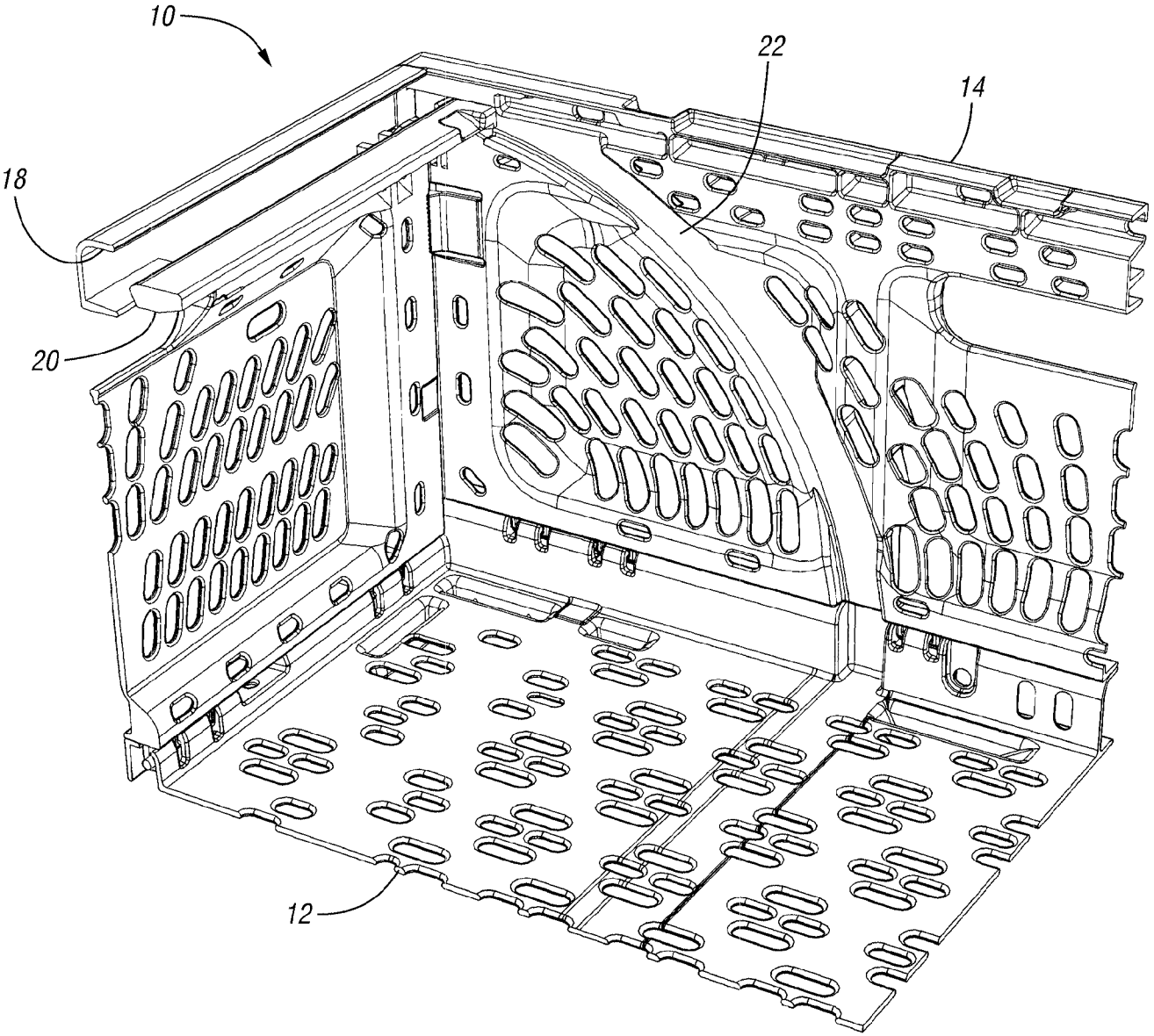
FIG. 3 is a perspective view of a quarter of the interior the collapsible container of FIG. 1.

FIG. 3 is a perspective view of a quarter of the container 10. The remainder of the container 10 is symmetric. The container 10 is shown in the upright (or assembled) position. Each end wall 18 has a support 20. The support 20 is pivotably and slidably mounted on the end wall 18 and movable between a retracted position and a support position. The support 20 is shown in FIG. 3 in support position, where it projects into the interior of the container 10 where it can support another container stacked thereon. The supports 20 project into arcuate channels 22 formed in each side wall 14. The ends of the supports 20 move in the arcuate channels 22 as the end walls 18 are collapsed onto the base 12.

Figure 4:
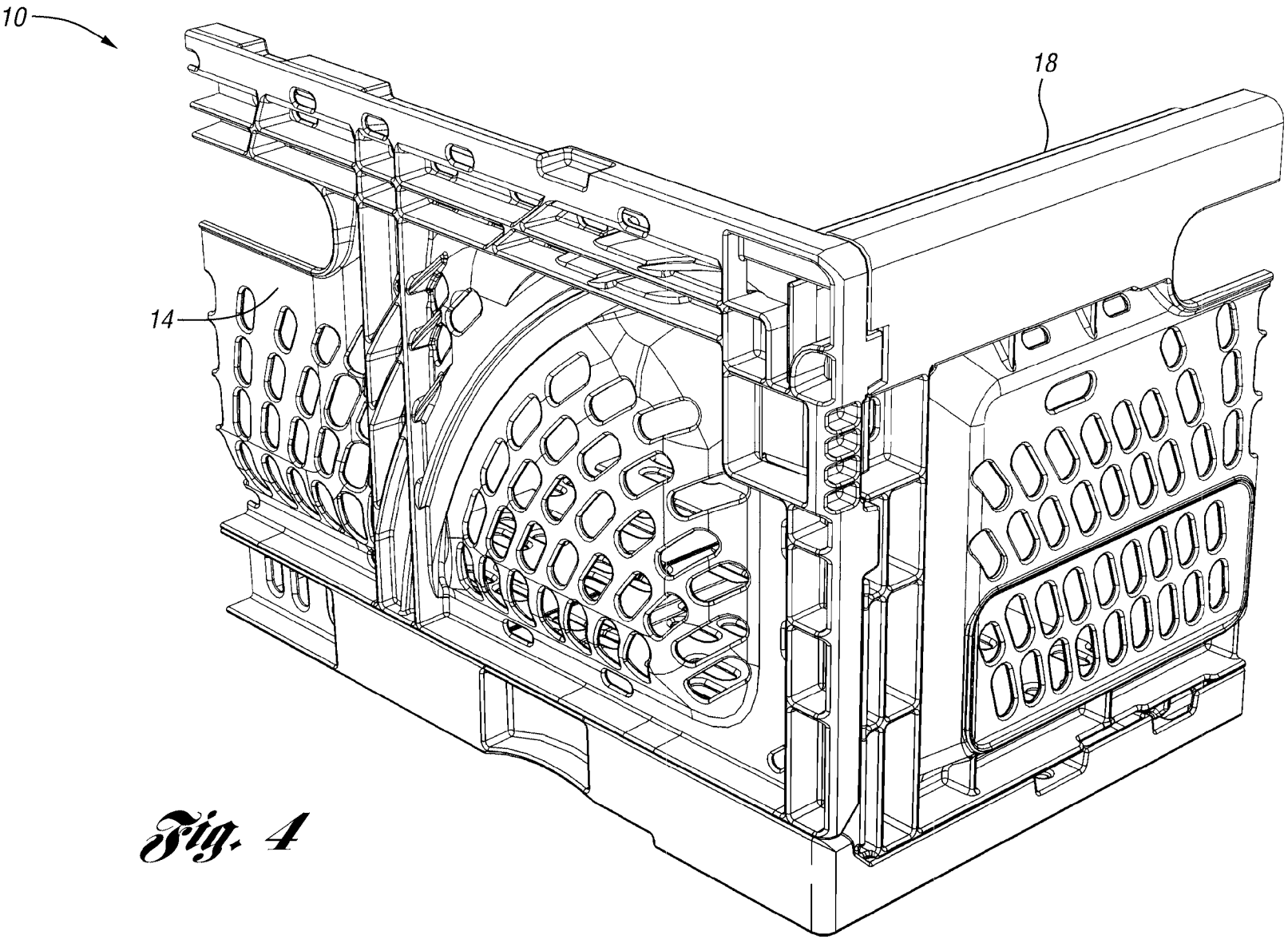
FIG. 4 is an exterior view of the corner of the collapsible container of FIG. 3.

FIG. 4 is an exterior view of the corner of the container 10 of FIG. 3.

Figure 5:
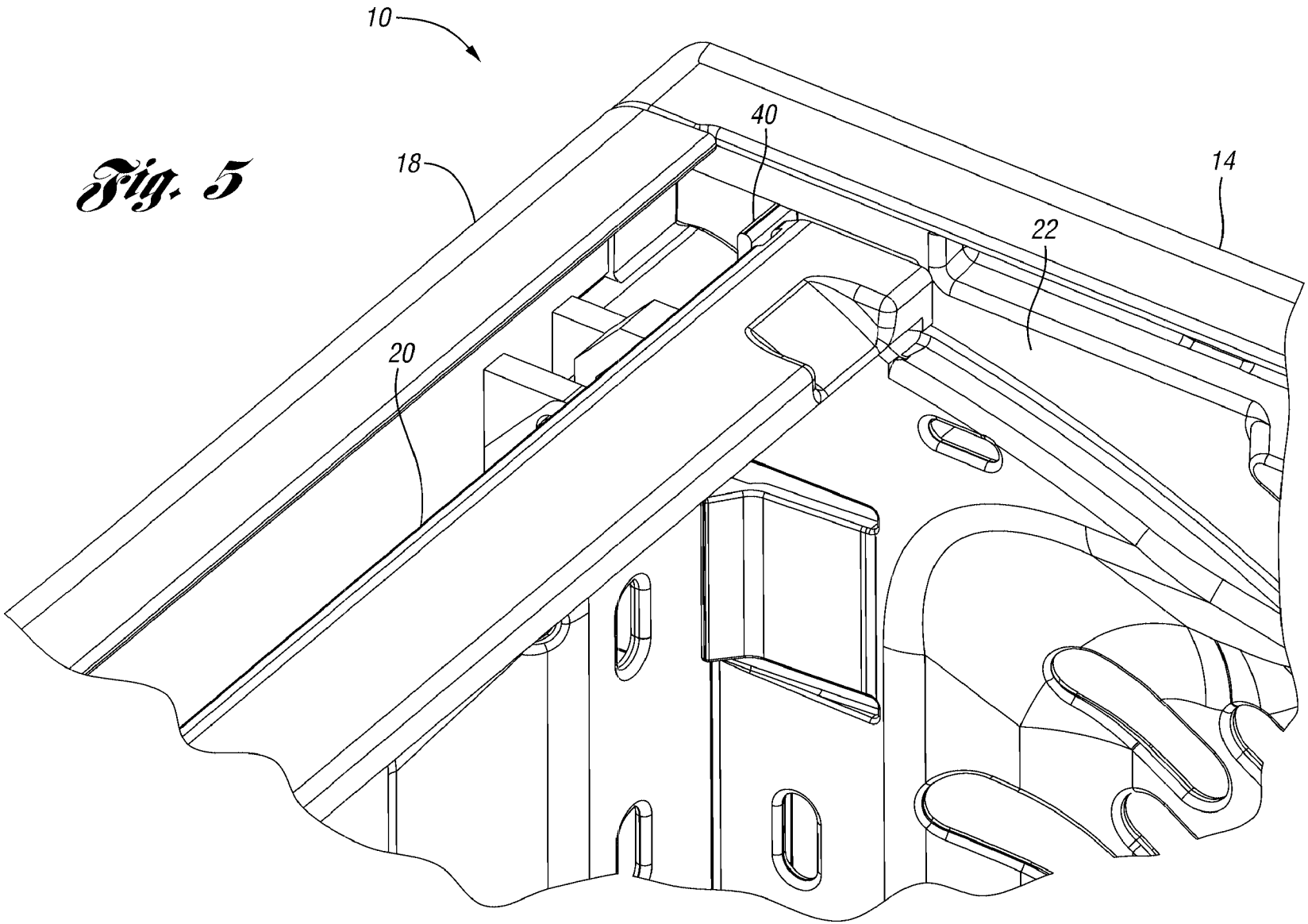
FIG. 5 is another view of the collapsible container of FIG. 3, showing in detail the support in the support position.

FIG. 5 is an enlarged view of the interior corner of the container 10 of FIG. 3. The side wall 14 includes an integrally molded deformable arm 40 (or some other deformable structure) that contacts an outer surface of the support 20. When the side wall 14 and end wall 18 are in the assembled, upright position as shown, the arm 40 urges the support 20 away from the end wall 18 to the support position.

Figure 6:
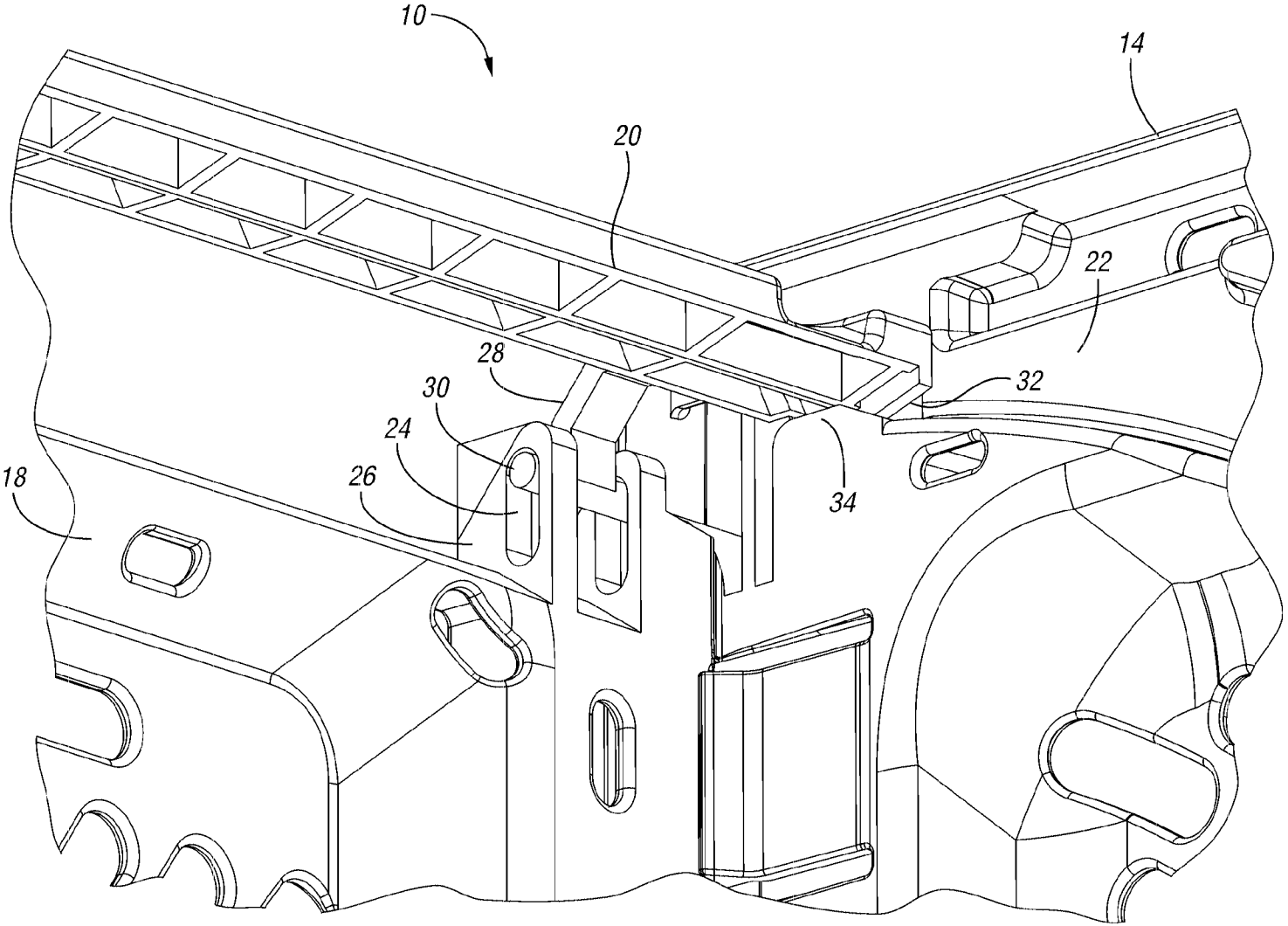
FIG. 6 is a bottom perspective view of the interior corner of FIG. 3.

FIG. 6 shows a bottom perspective view of the interior corner of FIG. 3. The end wall 18 includes a plurality of openings 24 formed in a plurality of brackets 26. The support 20 includes a plurality of arms 28 (one shown in this view), each having a hinge pin 30 formed at a lower end thereof. The hinge pins 30 are received in the brackets 26 and are captured in the openings 24 of the brackets 26. The hinge pins 30 are pivotable and slidable within the openings 24 in the brackets 26. The hinge pins 30 define a movable axis about which the support 20 pivots. The hinge pins 30 slide to the upper end of the openings 24 when the support 20 is in the support position 20. The arms 28 extend at an angle inwardly and upwardly from the hinge pins 30, such that the support 20 extends further into the interior of the container 10 than the supports in some known containers. The end of the support 20 includes a tab 32 projected downwardly behind a rail 34 adjacent the channel 22. The tab 32 interlocks with the rail 34 to prevent the side wall 14 from deflecting outward which could otherwise permit the support 20 to slip off of the side wall 14 when a load is placed on the support 20.

Figure 7:
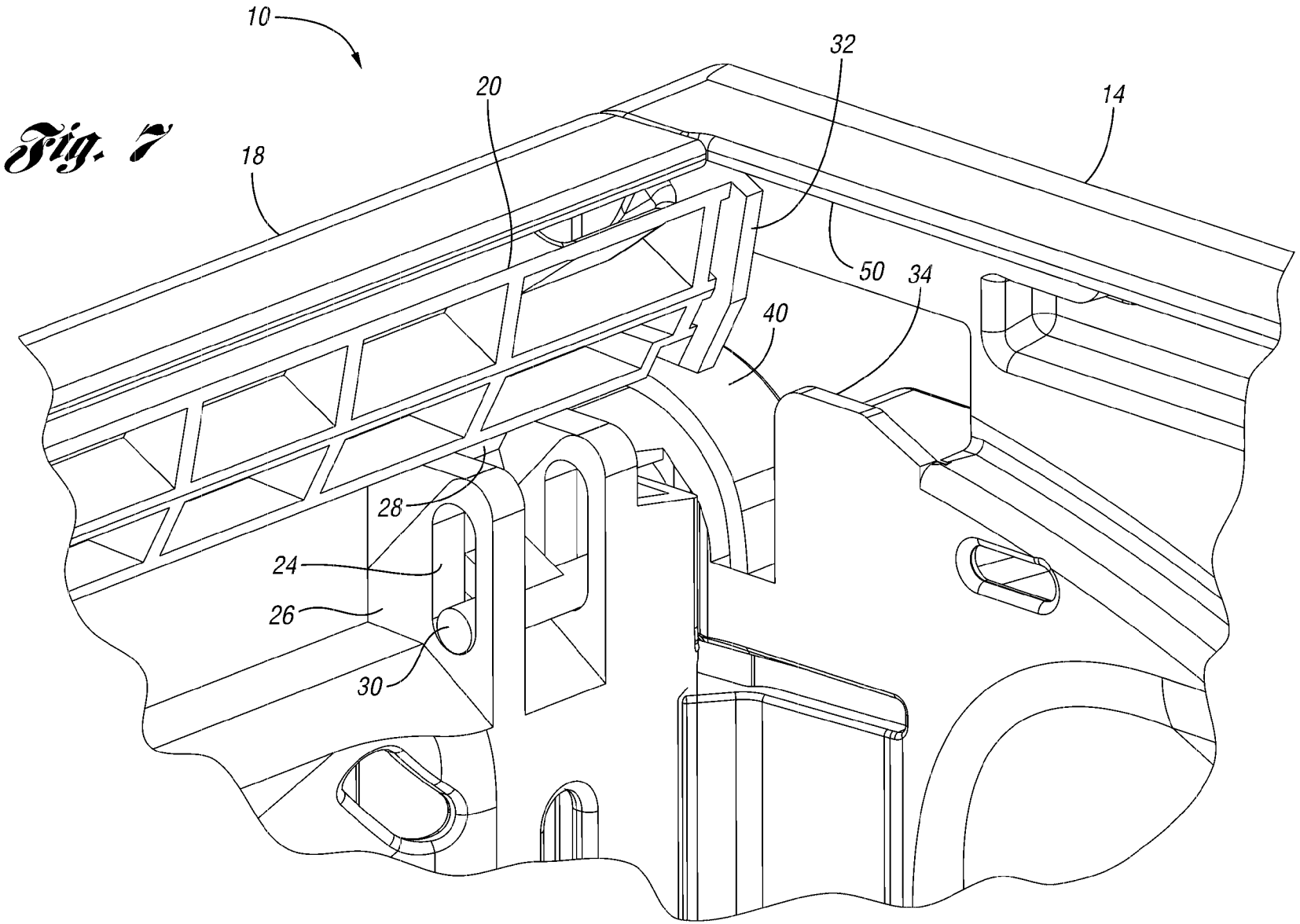
FIG. 7 is another view of the collapsible container of FIG. 3, showing the support in the retracted position.

FIG. 7 illustrates the support 20 moved to the retracted position within the end wall 18. The side wall 14 includes an upper rib 50 providing an upper contact surface that contacts the support 20 as the support 20 is moved toward the retracted position. As the support 20 is moved toward the retracted position, the arm 28 is pivoted outwardly and the support 20 contacts the upper rib 50, which causes the hinge pin 30 to slide downward within the vertically elongated openings 24. Also, as the support 20 moves toward the retracted position, the arm 40 is deflected outwardly. The arm 40 continues to urge the support 20 toward the support position, so the support 20 will return to the support position automatically upon release. Note that when the end wall 18 is collapsed onto the base, the support 20 is no longer biased toward the support position.

Figure 8:
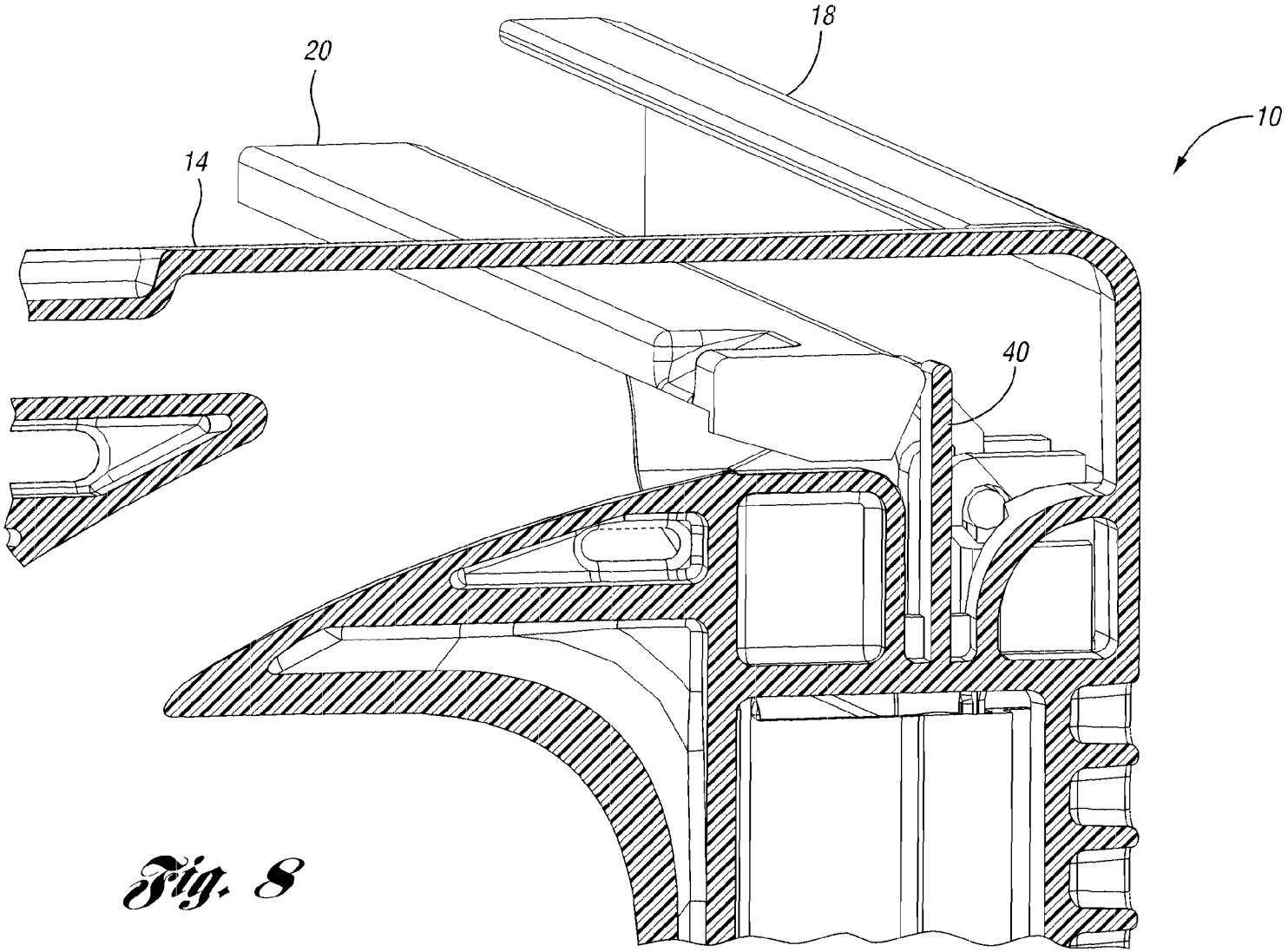
FIG. 8 is a section view through the side wall showing the arm of the side wall in an unbiased (or undeflected) state with the support in the support position.
Figure 9:
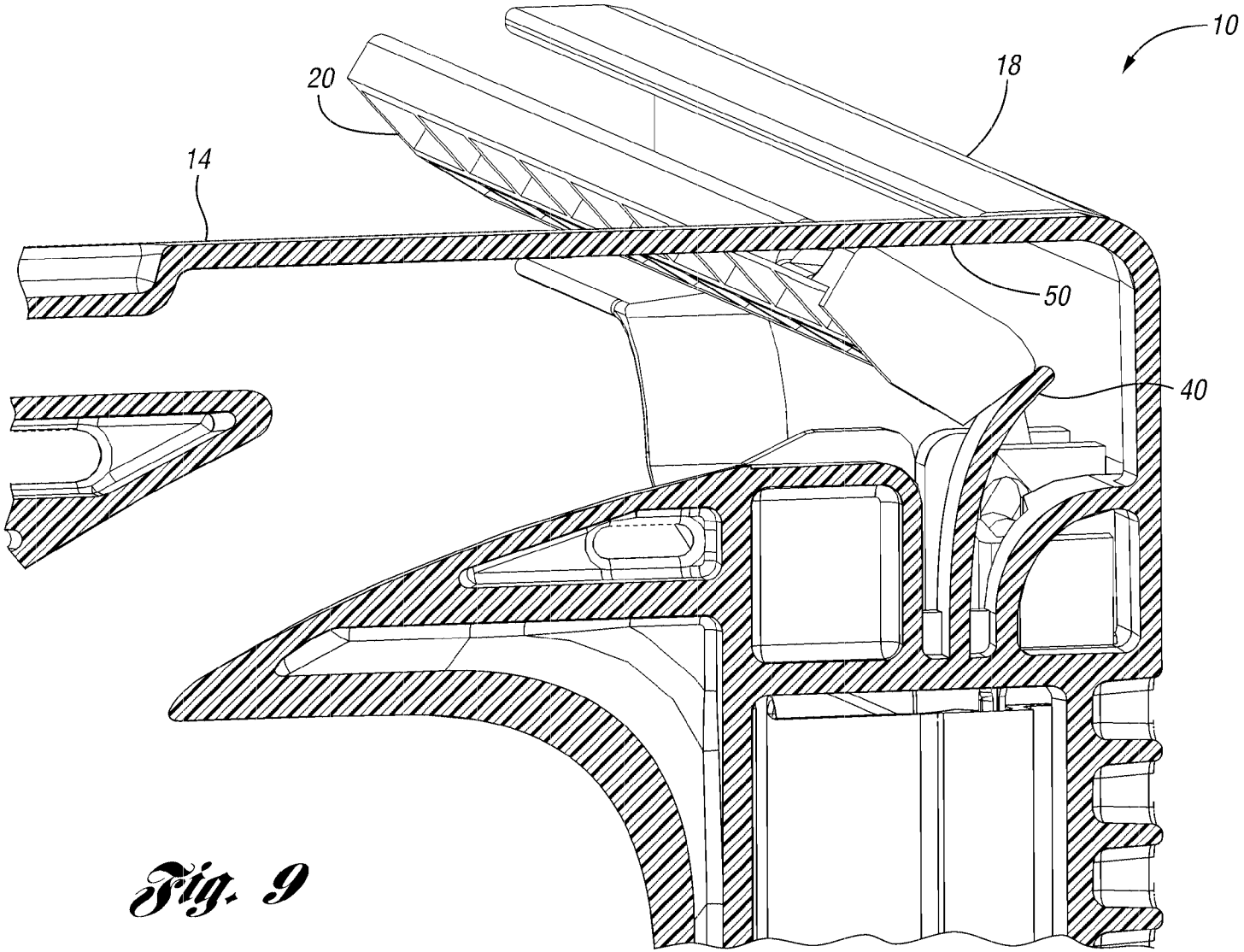
FIG. 9 is a section view through the side wall showing the arm of the side wall in a deflected state with the support in between the support position and the retracted position.
Figure 10:
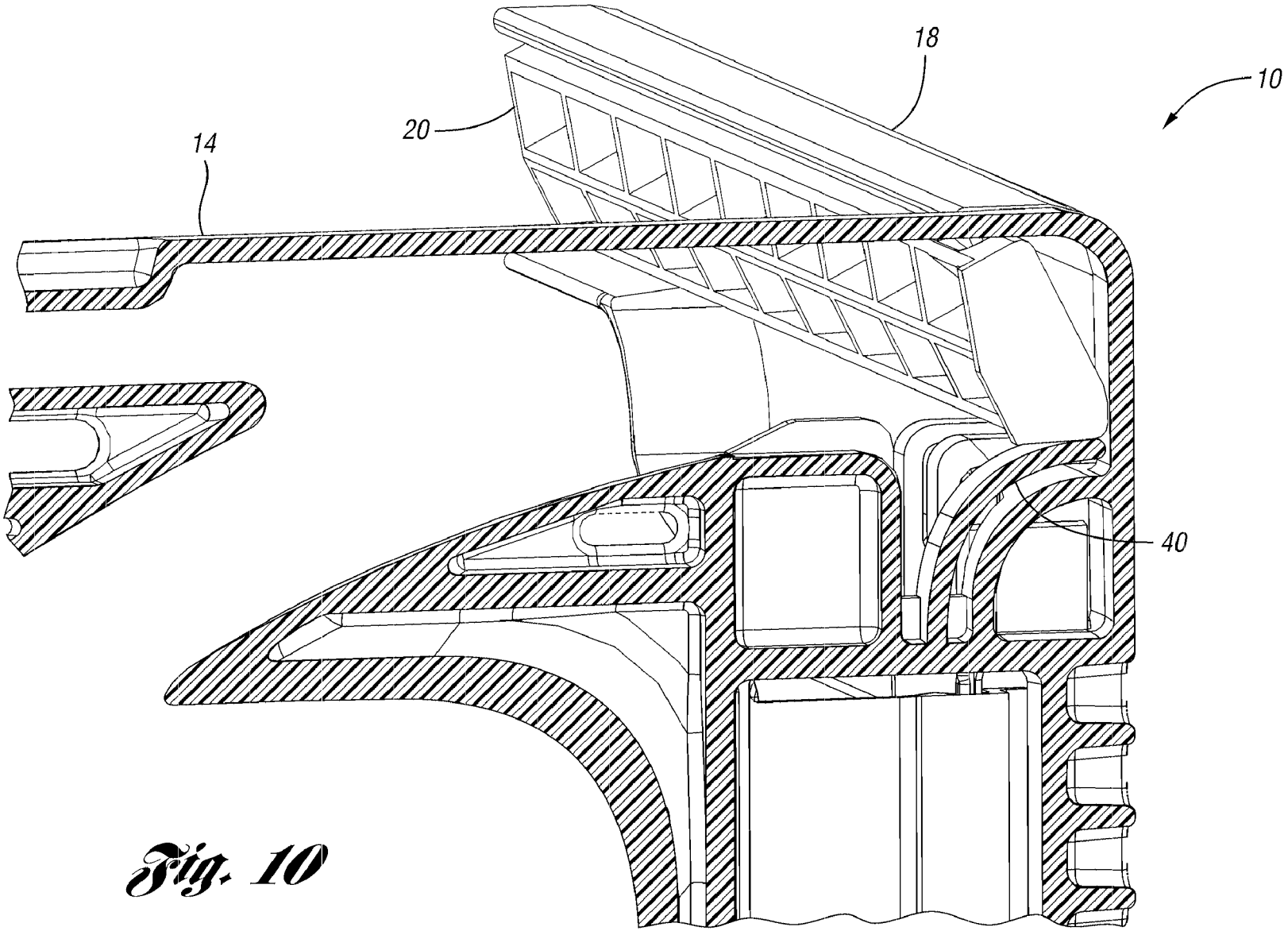
FIG. 10 is a section view through the side wall showing the arm in a deflected and elastically deformed state with the support in the retracted position.

FIG. 8 is a section view through the side wall 14 toward the interior of the container 10. When the support 20 is in the support position, the arm 40 is in contact with the support 20, but in an undeflected or substantially undeflected, undeformed state. Referring to FIG. 9, as the support 20 is pushed into the retracted position, the support 20 contacts the upper rib 50 of the side wall 14. This forces the support 20 to translate downward (i.e. the hinge pin 30 slides down within the opening 24 (FIG. 7)). As the support 20 is pushed toward the retracted position, the arm 40 is deflected and elastically deformed outwardly until the support 20 is received in the end wall 18 in the retracted position, as shown in FIG. 10.

Figure 11:
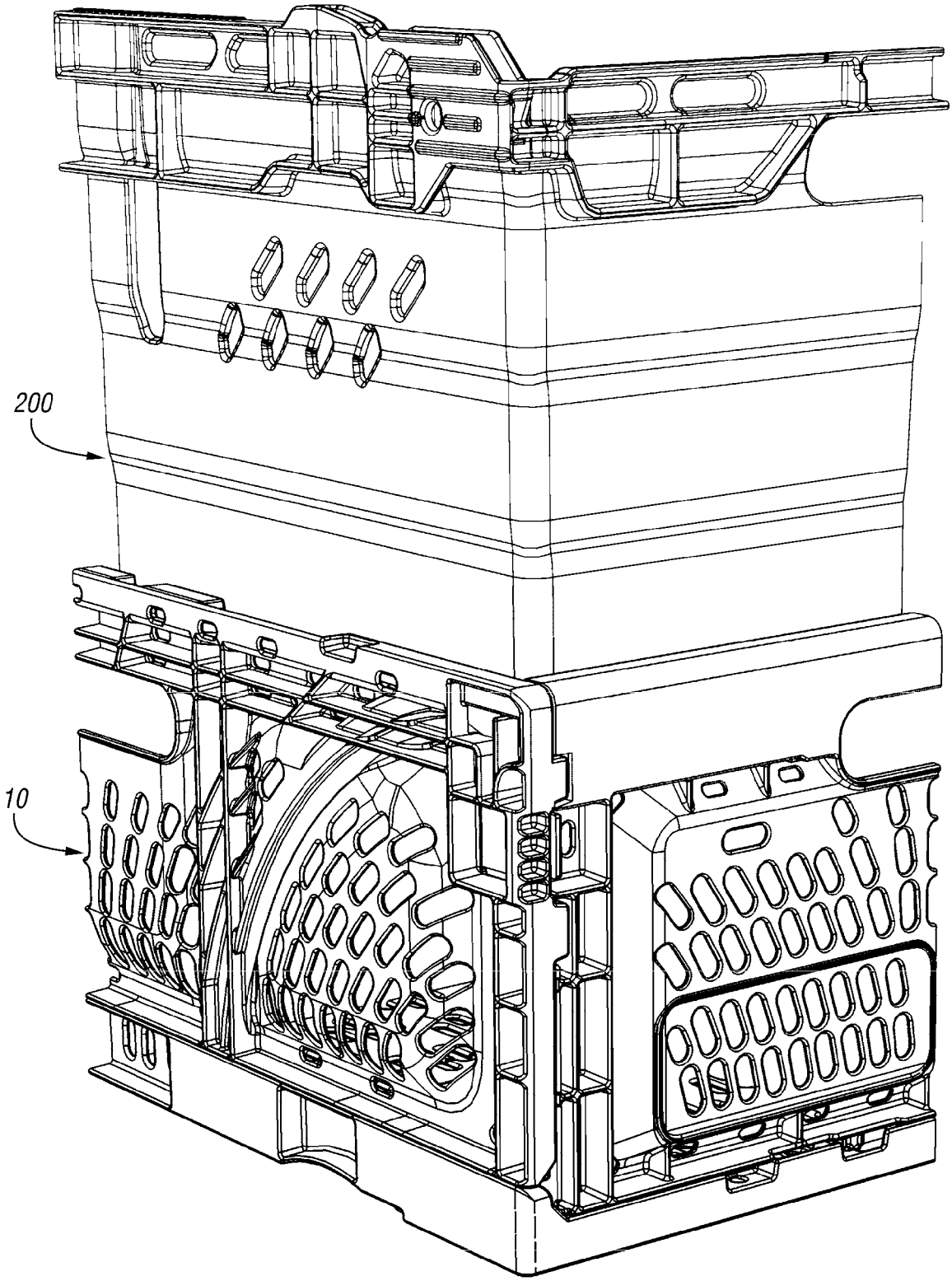
FIG. 11 is an exterior view of a corner of the collapsible container of FIG. 1 supporting a second container.
Figure 12:
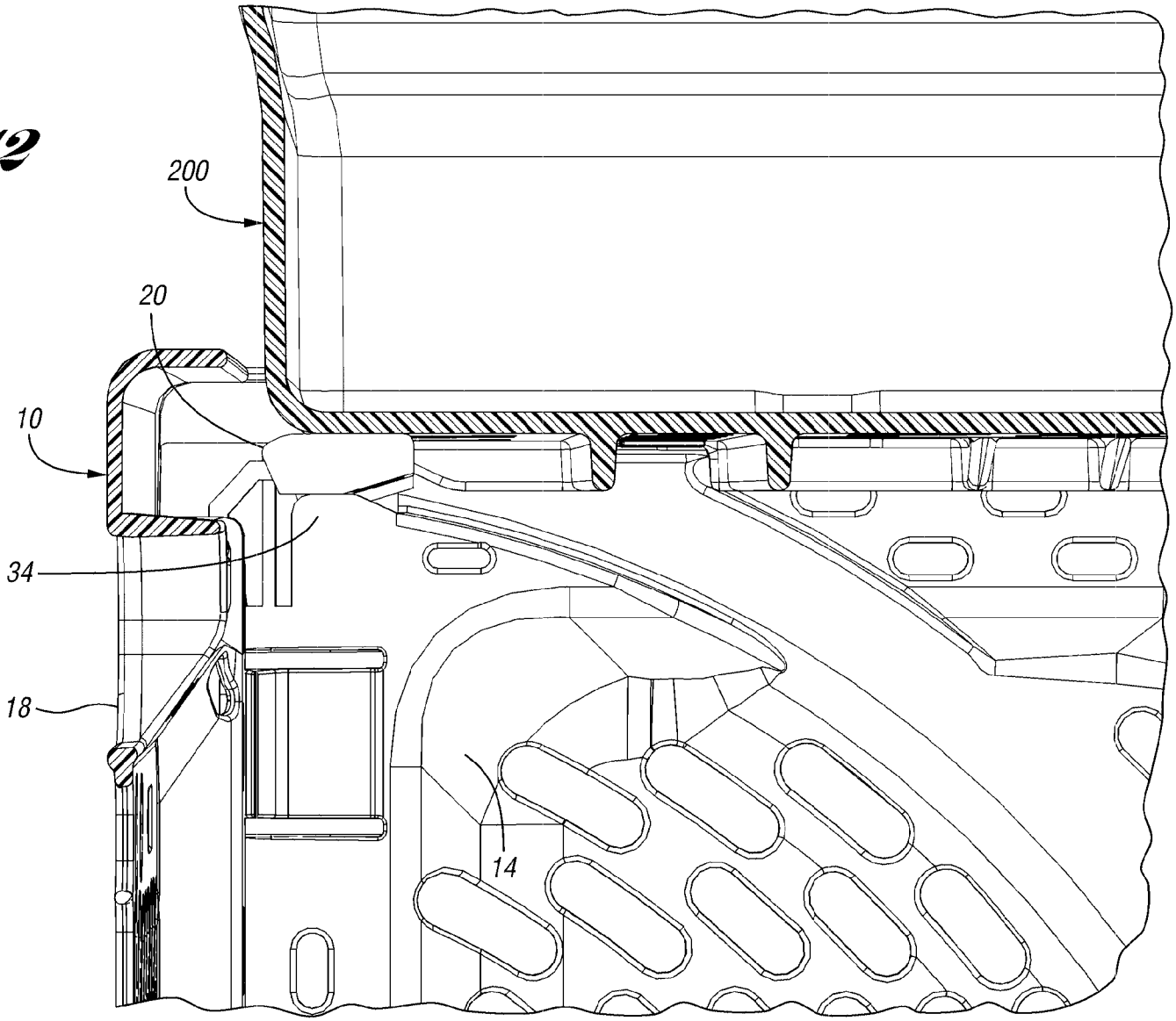
FIG. 12 is another view of the collapsible container of FIG. 1, showing in detail the support in the support position with a second container being supported on the support.

As shown in FIGS. 11 and 12, when the supports 20 are in the support position, a second container 200 can be supported on the supports 20. As shown in FIG. 12, the support 20 extends further into the interior of the container 10 than some of the supports in the known containers because the support 20 is at the end of a longer, angled arm 28 that pivots and slides relative to the end wall 18 as the support 20 moves to the support position.

Figure 13:
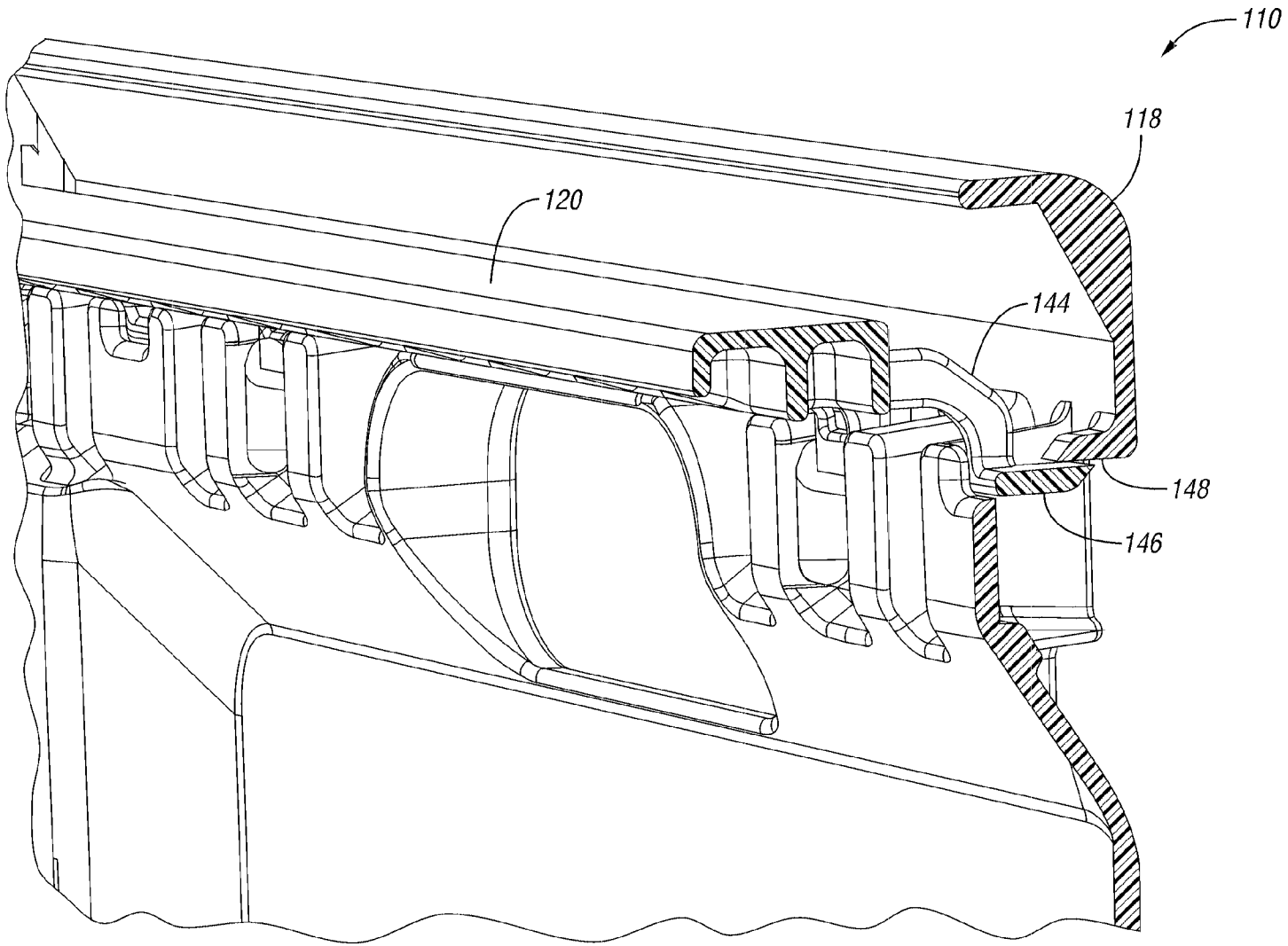
FIG. 13 is a perspective view of another embodiment of the support of the present application with the support in the support position.
Figure 14:
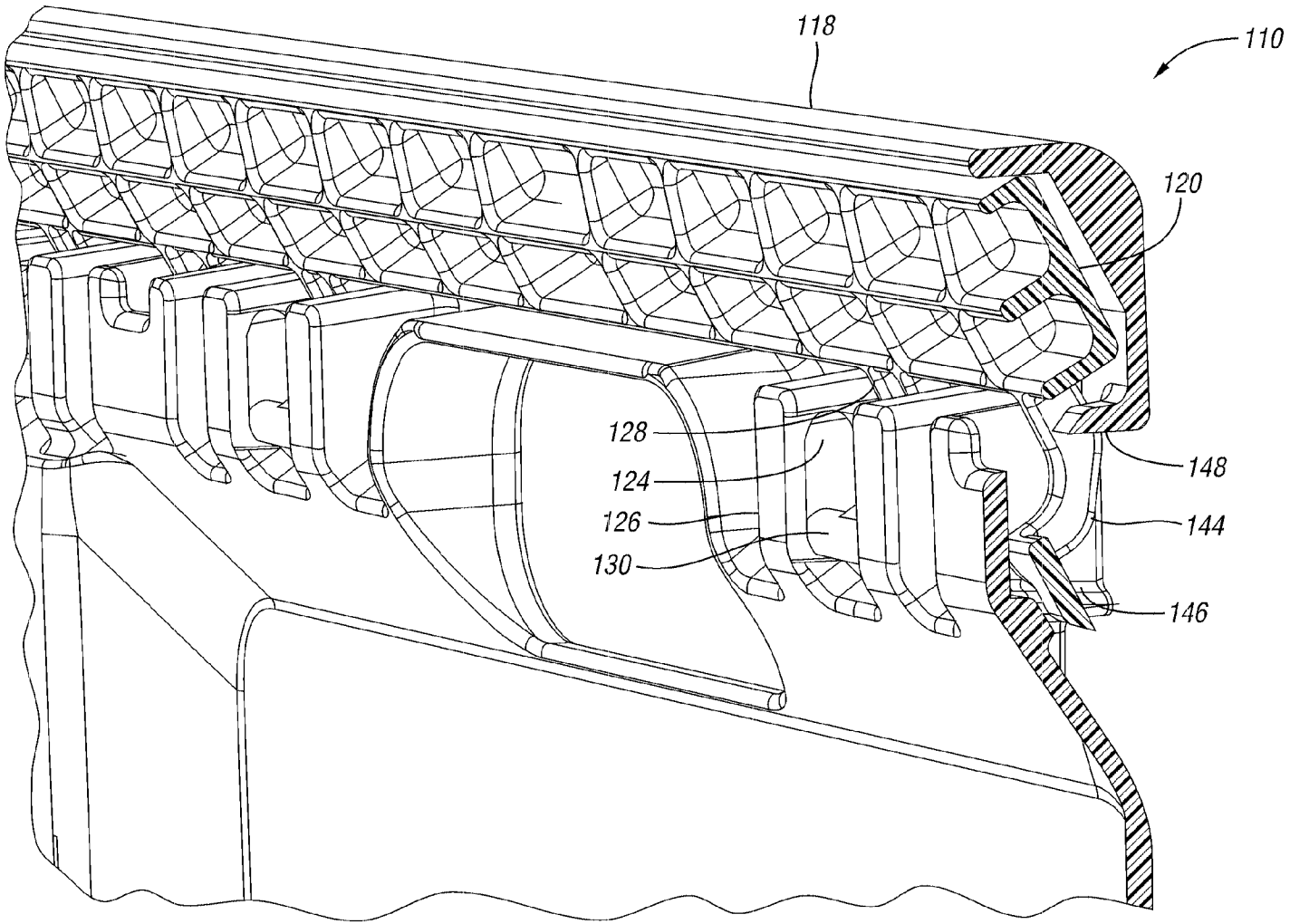
FIG. 14 is a perspective view of the embodiment of FIG. 13 showing the support in the retracted position.

FIGS. 13 and 14 illustrate an alternate container 110. The container 110 is substantially similar to the container 10 of FIGS. 1-12, and corresponding parts are referenced with the same reference number, preappended with the numeral "1." The container 110 includes supports 120 pivotably and slidably mounted to the end walls 118. The end wall 118 includes a plurality of openings 124 formed in a plurality of brackets 126. The support 120 includes a plurality of arms 128 (one shown in this view), each having a hinge pin 130 formed at a lower end thereof. The hinge pins 130 are received in the brackets 126 and are captured in the openings 124 of the brackets 126. The hinge pins 130 are pivotable and slidable within the openings 124 in the brackets 126. The hinge pins 130 define a movable axis about which the support 120 pivots. The hinge pins 130 slide to the upper end of the openings 124 when the support 120 is in the support position 120. The arms 128 extend at an angle inwardly and upwardly from the hinge pins 130, such that the support 120 extends further into the interior of the container 110 than the supports in some known containers. Each support 120 further includes one or more limit arms 144 projecting outwardly and downwardly therefrom. A stop 146 projects outwardly from each limit arm 144. When the support 120 is pivoted to the support position, as shown, the stop 146 contacts a corresponding stop 148 projecting inwardly from the end wall 118. The interference between the stops 146, 148 prevents the support 120 from over rotating inwardly when the support 120 is not supported on the side wall 114 (i.e., while the end wall 118 is being pivoted toward the collapsed position on the base). FIG. 14 illustrates the support 120 in the retracted position, where the stop 146 on the arm 144 of the support 120 is pivoted away from the stop 148 on the end wall 118.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A collapsible container comprising:
a base;
a side wall;
an end wall transverse to the side wall;
each of the side wall and the end wall being pivotably connected to the base between an upright position generally perpendicular to the base and a collapsed position on the base;
a support movable between a retracted position below an uppermost edge of the end wall and a support position extending into the container, wherein the support is pivotably mounted to the end wall about a movable pivot axis, the pivot axis being closer to the uppermost edge of the end wall when the support is in the support position than when the support is in the retracted position; and
when the sidewall and the end wall are in the upright position, the support is urged toward to the support position by an arm extending from the side wall.

2. The collapsible container of claim 1 wherein the end wall includes a bracket on an interior side of the end wall, the bracket including a vertically elongate opening; and
the support includes a hinge pin about which the support pivots, the hinge pin being received in the vertically elongate opening so as to allow the support to pivot and slide.

3. The collapsible container of claim 2 wherein the support includes a support arm extending upwardly and inwardly from the hinge pin to a support portion.

4. The collapsible container of claim 3 wherein the hinge pin slides to an upper end of the vertically elongate opening when the support is in the support position.

5. The collapsible container of claim 4 wherein the hinge pin slides to a lower end of the vertically elongate opening when the support is in the retracted position.

6. The collapsible container of claim 1 wherein when the support is pivoted from the support position and the retracted position, the support contacts a rib extending from the upper edge of the side wall and the pivoting movement of the support is translated into downward movement in response to the support contacting the rib.

7. The collapsible container of claim 1 wherein the support includes a limit arm projecting from the support and capable of engaging a stop formed in the end wall, the support is capable of engaging the stop when moving from the retracted position to the support position, engagement of the support with the stop prevents the support from rotating beyond the support position.

8. A collapsible container comprising:

a base;

a side wall;

an end wall transverse to the side wall;

each of the side wall and the end wall being pivotably connected to the base between an upright position generally perpendicular to the base and a collapsed position on the base;

a support pivotably and slidably mounted to the end wall, the support movable between a retracted position and a support position extending into the container; and when the side wall and the end wall are in the upright position, the support is urged toward the support position by an arm extending from the side wall.

9. The collapsible container of claim 8 wherein when the support is moved toward the support position the arm contacts the support such that the arm moves toward an unbiased state.

10. The collapsible container of claim 8 wherein when the support is moved from the support position to the retracted position the support deflects the arm.

11. The collapsible container of claim 8 wherein the side wall includes an upper rib extending from an upper edge thereof, and wherein pivoting the support from the support position toward the retracted position causes the support to be brought into contact with the upper rib such that the pivoting movement of the support is translated into a sliding downward movement of the support.

12. The collapsible container of claim 8 further including that the arm is elastically deformed in response to the sliding movement of the support.

13. The container of claim 8 wherein the support is mounted to an interior side of the end wall.

14. The collapsible container of claim 8 wherein, when the support is in the retracted position, the support is below an uppermost edge of the end wall.

15. A method for using a container having a base, a side wall, and an end wall extending transverse to the side wall, the method including the steps of:

moving the side wall and the end wall from a collapsed position on the base to an upright position;

moving a support from a retracted position below an uppermost edge of the end wall to a support position extending into the container by pivoting and sliding the support relative to the end wall, the support including a support portion and an arm portion, the arm portion connecting the support portion to the container; and urging the support toward the support position by an arm on the side wall when the sidewall and end wall are each in the upright position.

16. A container comprising:

a base;

a side wall;

an end wall transverse to the side wall;

each of the side wall and the end wall being connected to the base;

a support movable between a retracted position below an uppermost edge of the end wall and a support position extending into the container, wherein the support is pivotably mounted to the end wall about a movable pivot axis, the pivot axis being closer to the uppermost edge of the end wall when the support is in the support position than when the support is in the retracted position; and wherein the support is urged toward the support position by an arm extending from the sidewall, when the side wall and end wall are each in the upright position.

17. The container of claim 16 wherein the support is configured to pivot and slide relative to the end wall.

18. The container of claim 16 wherein, when the support is pivoted from the support position and the retracted position, the support contacts a rib extending from the upper edge of the side wall and the pivoting movement of the support is translated into downward movement in response to the support contacting the rib.

* * * * *